US005927439A

United States Patent [19]

Hanns

[11] Patent Number: 5,927,439

[45] Date of Patent: Jul. 27, 1999

[54] SUB-ASSEMBLY FOR LUBRICATING ROCK DRILL BIT

[76] Inventor: David Thomas Hanns, 45 Spinnaker Ridge Way, Belmont, N.S.W 2280, Australia

[21] Appl. No.: 08/823,995

[22] Filed: Mar. 25, 1997

[51] Int. Cl.[6] ..... F16H 7/30

[52] U.S. Cl. ..... 184/55.1; 184/6.14; 175/228; 175/229

[58] Field of Search ..... 384/93; 175/227, 175/228; 184/55.1, 31, 6.14

[56] References Cited

U.S. PATENT DOCUMENTS

| | | | |
|---|---|---|---|
| 3,675,729 | 7/1972 | Neilson | 175/228 |
| 3,942,596 | 3/1976 | Millsapps, Jr. | 175/227 |
| 4,199,856 | 4/1980 | Farrow et al. | 29/454 |
| 4,276,946 | 7/1981 | Millsapps, Jr. | 175/228 |
| 4,399,878 | 8/1983 | Karlsson et al. | 175/227 |
| 4,577,705 | 3/1986 | Cross | 175/228 |
| 4,593,775 | 6/1986 | Chaney et al. | 175/228 |
| 4,942,930 | 7/1990 | Millsapps, Jr. | 175/228 |
| 5,099,932 | 3/1992 | Hixon | 175/229 |
| 5,490,571 | 2/1996 | Hanns et al. | 175/323 |

*Primary Examiner*—Charles A. Marmor
*Assistant Examiner*—David Fenstermacher
*Attorney, Agent, or Firm*—Rockey, Milnamow & Katz, Ltd.

[57] ABSTRACT

A lubricating sub-assembly for a rock drill, comprising a housing coupled into a drill string carrying a drill bit at its front end, a cavity disposed within the housing for holding a predetermined amount of a bearing lubricant, passages for communicating the interior of the cavity with one or more air circulation passages provided in the bit leading to bearings within the drill bit, and a valve mechanism for dispensing a preset amount of lubricant from the cavity to the communicating means passages.

28 Claims, 4 Drawing Sheets

SUB-ASSEMBLY FOR LUBRICATING ROCK DRILL BIT

TECHNICAL FIELD

The present invention relates to the lubrication of drill bits used in rock drilling operations and in particular to a sub-assembly to provide lubricant to the bearings and wear surfaces of a rock drill bit.

Drilling into bedrock, for example, to enable explosive charges to be placed for excavating ore in open-cut mining operations can be carried out by either rotary air blast drills (RAB-drills) and/or hammer drills.

The drill bit is mounted at the forward end of a drill string consisting of sections joined together by appropriate connectors at either end of each section. A stabiliser section may be located behind the actual drill bit to centre the drill bit within the bore hole. Two standard connection threads are generally used in the drilling industry, namely, BECO and API, and a crossover connector is often required to accommodate sections and sub-assemblies having different connection threads.

In the case of RAB-drills, air at high pressure (typically 40 psi) and volume (750 to 2000 cubic feet per minute) is delivered through a bore in the drill string to the drill bit. The vast majority of the air supplied to the drill bit which may, for example, be a blade or roller type bit, exits from a jet nozzle arranged in the interior dome area of the body of the bit which rotatably mounts the bit cones. The air jet is used to convey the debris created by the drilling operation away from the drilling work face of the borehole. This debris travels up the borehole past the drill string at a typical bailing velocity of 5,000 to 7,000 feet per minute depending on the size of the borehole and the drill string. A portion of the air flow is directed through so called air circulation passages in the drill bit body for cooling the bearings of the bit cones.

The debris produced includes particulate matter and dust. To reduce the dispersion of dust into the environment, which has deleterious effects on both equipment and personnel, the debris can be sprayed with water. With conventional drill bits, the water is supplied with the air through the drill string into the drill bit where it exits together with the air through the jet nozzle. However, in addition to suppressing dust, the water also causes corrosion, in particular of the bearings. It also produces a slurry which causes wear of the cutting surfaces of the drill bit, reducing the life of the bit and reducing drill penetration rates. Both these are detrimental to operation costs since the drill bit is a costly item to replace and the drill penetration rate is the single most important factor in operational costs.

It is known with conventional roller type bits to provide in the air circulating passages so-called air bearing filters to reduce water ingress into the bearings. However, none of the air bearing filters commercially available effectively reduce water ingress to the bearings and corrosion problems which reduce bit life.

WO93/20331, to which U.S. Pat. No. 5,490,571 corresponds, discloses a sub-assembly for dust suppression in rock drilling which effectively separates the blast air from the water such that air only is passed onto the drill bit while the water is injected into the upward travelling debris behind the drill bit. The sub-assembly is inserted in the drill string behind the drill bit and includes a spiral raceway arranged within an inner tubular housing which itself is arranged co-axially within an outer tubular housing. The air-water mixture enters the inner housing and is centrifuged as it passes along the spiral raceway so that the liquid is expelled through a number of orifices along the inner housing wall and into the chamber between the inner and outer housing. The separated water is directed through apertures in the outer housing into the drill bore. At the end of the spiral raceway, essentially air only passes through openings into the drill bit. Thus, corrosion of the bearings due to water ingress is substantially avoided whilst still ensuring proper cooling of the bearings through the air circulation passages.

With conventional RAB-drills attached to the drill string it has also been proposed to introduce a water soluble lubricant into the air-water mixture for lubricating the bearings of the bit in order to reduce water induced corrosion and extend bit life. One such additive lubricant is known under the trade name SPHERE-TRI-LUBE, distributed by Sheer Drilling Supplies, Calgary, Alberta, Canada. The lubricant is added to provide a ratio of 1:150 lubricant to water. However, such addition of lubricants to the air-water mixture does not entirely suppress corrosion and due to the layout of conventional RAB-drill bits, most of the lubricant is expelled with the air-water mixture through the jet nozzle and only a small amount actually is directed into the bit housing air channels to lubricate the bearings. Also, drill bit life is only minimally extended as compared to drill operations without additive lubricant. Also, this method of introducing lubricant into the air-water mixture would be fruitless where a dust suppression sub-assembly of above described type is incorporated into the drill string, since the lubricant would be separated together with the water prior to reaching the drill bit.

It would thus be advantageous if the present invention could provide a lubricating system for the bearings and bearing surfaces within a rock drill bit, i.e. roller type bits, which provides a useful alternative to existing methods of lubrication.

DISCLOSURE OF THE INVENTION

According to a first aspect of the invention, there is provided a lubricating sub-assembly for a rock drill, comprising a housing with means to link the sub-assembly into a drill string, preferably adjacent the drill bit, a cavity being disposed within the housing for holding a predetermined amount of a bearing lubricant. The sub-assembly further incorporates means for communicating the interior of the cavity with one or more air circulation passages provided in the body of the drill bit which lead to bearings for the bit cones within the drill bit body, and means for dispensing an amount of the lubricant from the cavity to the communicating means preferably only when air is being conveyed through the drill string into the drill bit during drilling operations.

Preferably, the lubricating sub-assembly can be incorporated into a sub-assembly for dust suppression as disclosed in WO93/20331, to which U.S. Pat. No. 5,490,571 corresponds and the contents of which is incorporated herewith by way of short hand cross-reference thereto. Alternatively, the lubricating sub-assembly may be a self-contained modular unit comprising its own housing section which is attached at either end by hollow threaded connections, which may be either male or female, between a dust suppression sub-assembly and the drill bit.

Advantageously, the lubricating sub-assembly housing may comprise an outer housing portion and an inner housing portion, the inner housing defining at least part of the cavity and at least one air passage extending between the inner and outer housing for air to pass through the sub-assembly and be directed to the drill bit. Preferably, the inner and outer housings are co-axial cylinders of different radii.

Advantageously, the dispensing means comprise a pneumatically activated one-way valve arranged such as to be operable by air flow through the drill string into a lubricant dispensing position.

Preferably, the one-way valve incorporates a poppet-type actuating rod biased to close a dispensing opening between the cavity and the communicating means.

The actuator rod may preferably be hollow with at least one longitudinal end thereof closed such as to define a part cavity for the lubricant, the interior of the rod being in fluid communication with the interior of the inner housing, the dispensing opening being provided near the closed longitudinal end of the rod so as to communicate the interior of the rod with its exterior and arranged to be closed against a sealing surface when the rod is in a non-dispensing position and be opened towards the communicating means upon actuation of the rod by displacing the same along its longitudinal extension into a dispensing position. The actuating rod is advantageously received co-axially within the inner housing and the interior of the hollow rod defines part of the cavity and the volume space between the interior surface of the internal housing and the exterior surface of the rod defines a further portion of the cavity, the interior of the rod being in fluid communication with the exterior. Alternatively, the hollow rod can have an outer diameter substantially equal to the inner diameter of the interior housing such as to be received with a slide fit within the internal housing, whereby the hollow actuator rod provides the entire cavity for holding the bearing lubricant.

Advantageously, the lower longitudinal end of the rod is received within or passes through an annular seat member with an intermediate fit that enables the actuator rod to reciprocate therein, the dispensing opening being arranged in the circumferential wall of the rod such that when the rod is in the non-dispensing position, the dispensing opening is closed by an internal surface of the annular seat member and when the rod is in the dispensing position, lubricant can exit the dispensing opening to enter the communicating means.

The dispensing opening can be dimensioned such that gravity feeding can be achieved at a predetermined flow rate and in dependence of the viscosity of the lubricant. Alternatively, pressurization means can be provided communicating with the cavity to generate a pressure differential to expel lubricant through an appropriately dimensioned dispensing opening and with a predetermined flow rate.

Preferably, the cavity and/or the hollow actuator rod is arranged such as to be refillable. Heretofore, the hollow actuator rod may be provided at a terminal upper longitudinal end thereof with an opening communicating with the interior of the rod and closeable by a screw received within said opening. To facilitate the lubricant refill operation, the hollow actuator rod may comprise at least one lubricant balance hole.

In an alternative embodiment of the one-way valve, the upper-type actuating rod incorporates a piston portion arranged to provide positive pressurization of the lubricant upon the rod being depressed. Heretofore, the rod may comprise a first, upper portion of greater diameter than a second, lower end portion, an annular shoulder between the portions providing a displacement piston surface which can be reciprocatingly moved into and out of a pressurization cylinder formed in integral extension of the annular seat member, a dispensing channel or slit being formed in the lower rod portion which is received within and closes a dispensing orifice of the seat member. The arrangement is such that when the actuating rod is in its non-dispensing position, the piston surface is located outside the pressurization cylinder and the latter is in fluid communication with the chamber holding the lubricant within the interior housing and the dispensing orifice in the seat member is fluidly sealed off by the lower end rod portion. When the rod is moved into the lubricant dispensing position, the piston surface enters the pressurization cylinder thereby sealing of the cylinder for a short time span and pressurising the lubricant contained therein. When the dispensing channel of the lower rod end comes into fluid communication through the seat orifice with the communicating means leading to the drill bit, lubricant is expelled under pressure towards the drill bit.

A backflow valve is advantageously provided between the interior of the pressurization cylinder and the chamber of the internal housing holding the lubricant to facilitate the rod being moved back into its non-dispensing position.

Notwithstanding any other forms that may fall within the scope of the invention, preferred embodiments will now be described by way of example only with reference to the accompanying drawings in which:

BEST MODE FOR CARRYING OUT THE INVENTION

Figure 1:
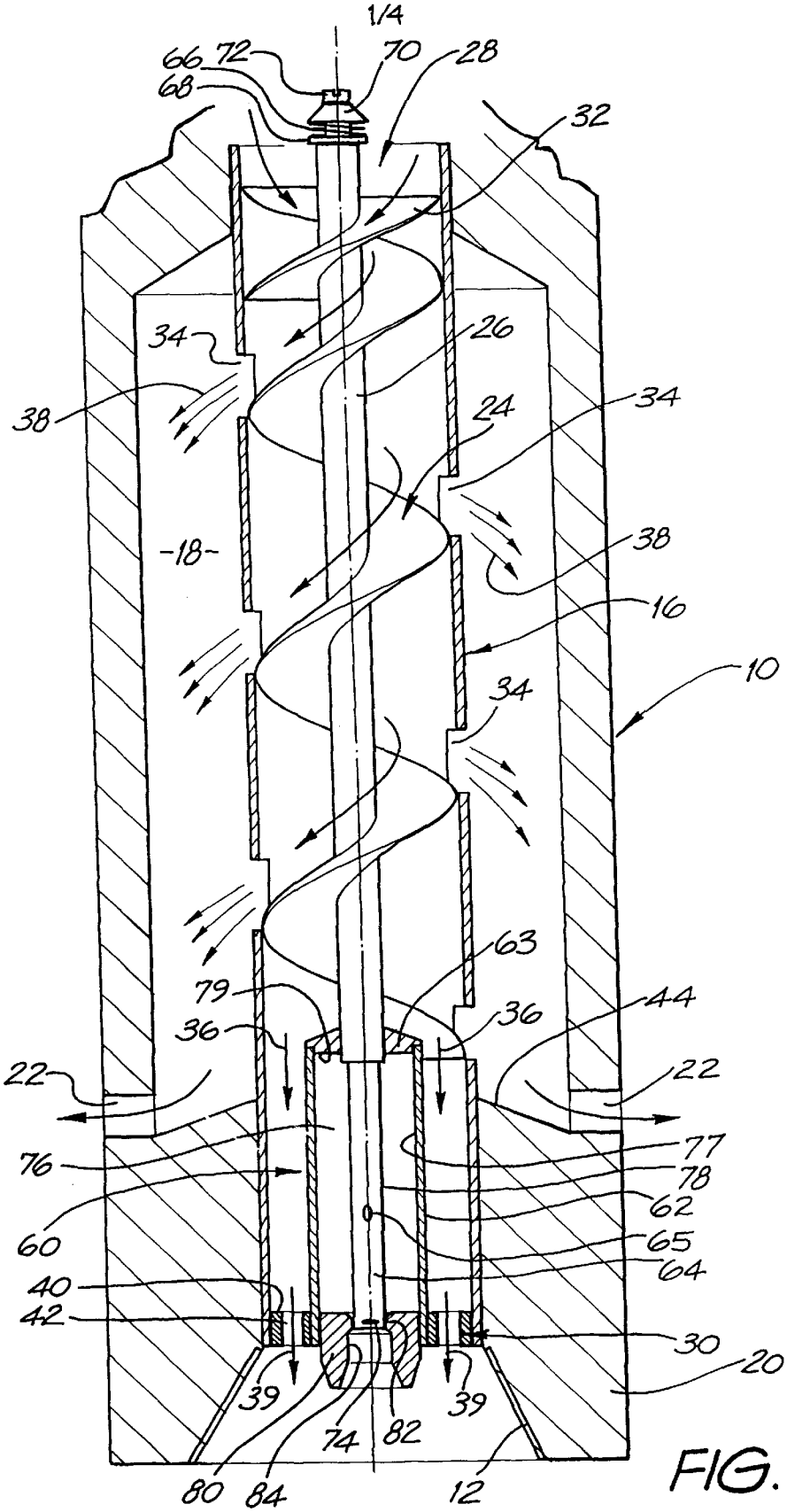
FIG. 1 is a schematic partial longitudinal section of a sub-assembly for dust suppression and lubricating rock drill bits in accordance with a preferred embodiment of the invention, the lubricating sub-assembly being integral with the sub-assembly for dust suppression.
Figure 2:
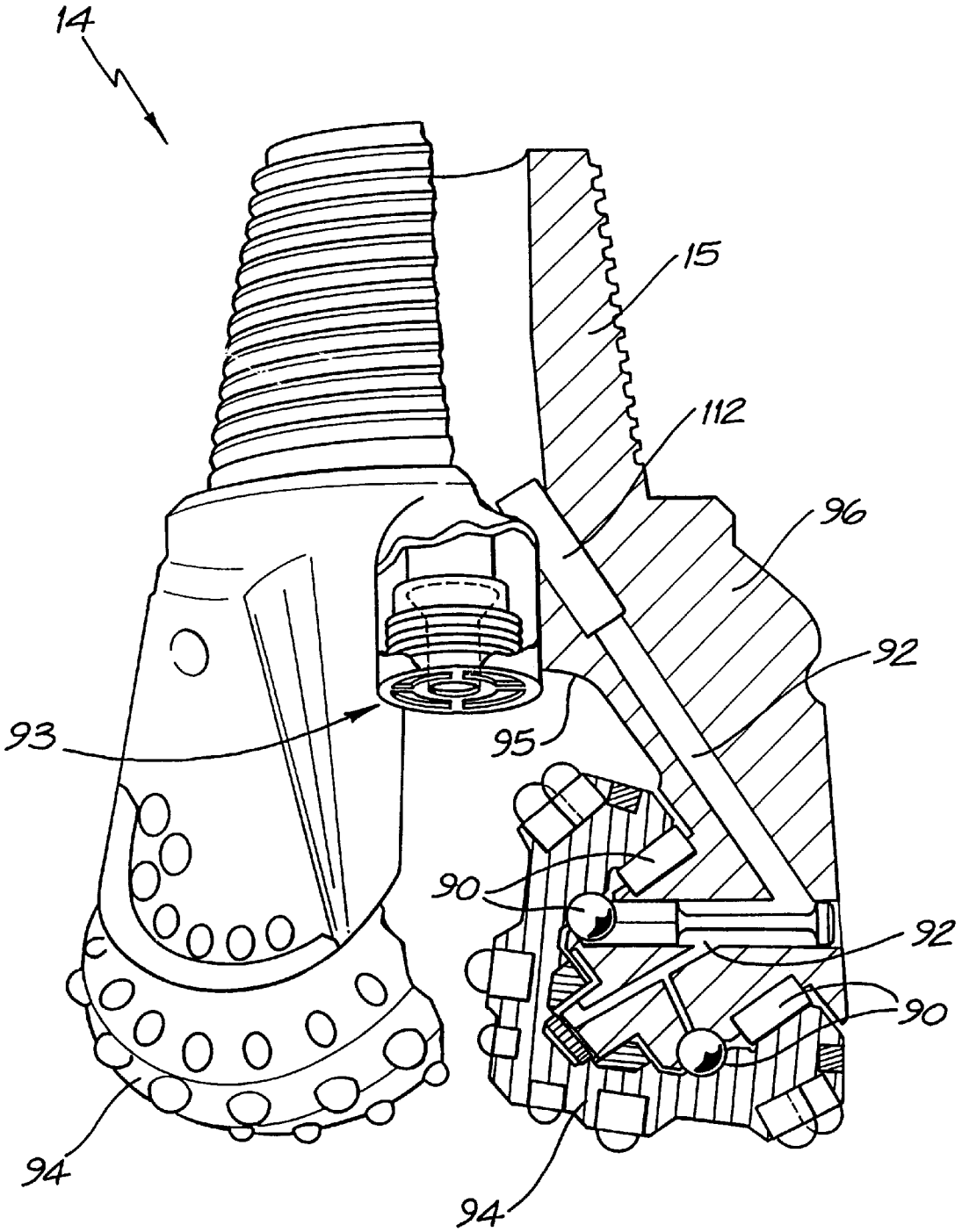
FIG. 2 is a schematic illustration, in part in longitudinal section, of a conventional roller type bit for use with the sub-assembly illustrated in FIG. 1.

FIG. 1 illustrates in schematic, partial longitudinal section a sub-assembly for dust suppression and lubricating drill bits which is mountable in a drill string behind the drill bit head. The sub-assembly comprises an outer cylindrical housing 10 which has at its lower portion 20 a tapered rotary connection 12 adapted to receive the threaded rotary shoulder connection 15 of a drill bit 14 illustrated in FIG. 2. This detachable connection is of conventional nature and known in the field; it will not be described any further.

The sub-assembly also comprises a cylindrical inner housing 16 which is coaxial with the outer housing 10 but of lesser radius so as to create an annular chamber 18 between the inner housing 16 and the outer housing 10. Around the periphery of the outer housing 10 and towards the lower housing end 20, which in use receives the drill bit 14 and has a greater wall thickness than the upper part, are provided a series of radially extending through holes 22. The inner housing 16 has arranged therein a tight-fitting spiral flange 24 supported on a hollow central rod or tube 26 which is arranged coaxially with the inner and outer housings 16, 10. The spiral flange 24 extends between an axial inlet opening 28 on the upper terminal end of the inner housing 16 and ends with distance from an exhaust opening 30 in the lower terminal end of the inner housing 16. The spiral flange 24 provides a centrifugal raceway for an air-liquid mixture fed into the sub-assembly as will be described hereinafter. A second spiral raceway 32 having only about one 180° turn is arranged 180° angularly spaced apart from the first spiral raceway 24 such as to provide a second short initial centrifugal raceway for the air-liquid mixture to be conveyed and separated in the dust suppression sub-assembly as described below.

The inner housing 16 is provided with a plurality of slots 34 in its wall located 180° angularly spaced apart and along the length of the inner housing 16 such as to be located adjacent the points where the spiral flange or raceway 24 abuts against the inner surface of the inner housing 16.

In operation of the dust suppression sub-assembly connected to a rock drill bit, water and air enter through the inlet opening 28 into the inner housing 16 from the drill string connected at the top end of the sub-assembly (not shown), and flow along the spiral raceways 32 and 24. The water is forced gradually outwards by the centrifugal action of its motion along the downward path on the spiral and exits, as shown by arrows 38, through the plurality of slots 34 along the length of the inner housing 16 into the chamber 18 between the inner housing 16 and the outer housing 10. As would be evident to a skilled person in the art, the water is progressively removed from the in-coming air-water stream as it progresses in downward direction along the spiral raceway 24. The edges of the slots 34 may be shaped with a trailing edge in the direction of travel of the water so as to be curved inwards to act as deflectors or scrapers to scrape the water from the inner walls of the inner housing 16 and direct the water radially outwards.

Due to the differences in mass, substantially only air as indicated by arrows 36 passes the lower terminal end of the spiral raceway 24 and exits the inner housing 16 as indicated by arrows 39 through a plurality of axially extending, equidistantly spaced apart bores 42 provided in an annular support bush 40 mounted at the terminal end of the inner housing 16. The air continues down into the interior of the shouldered connection 14 of the drill bit 16 illustrated in FIG. 2.

On the other hand, the water expelled through the radial slots 34 continues to move outwards under the effect of centrifugal forces, which results in a further separation of water and any entrained air. The water gathers at the inward facing surface of the outer housing 10 while the air tends to gather towards the outer surface of the inner housing 16. The water separated by this action travels down the inward facing surface of the outer housing 10 where it exits the dust-suppression sub-assembly through the radially extending holes 22 at the base of taper boss 44.

In use, the radial holes 22 spray the expelled water onto the debris forced up the bore hole by the pressurised air exiting from the drill bit 14 in a manner to be described more fully below. The pressure in the volume space between the inner and outer housings 16, 10 is positive with respect to the outside of the outer housing 10 received in the bore hole and provides positive pressure to eject the water through the radial holes 22. The size and number of radial bores 22 depends on the volume of water to be dispersed and on the desire to avoid excessive pressure loss in the upward travelling debris.

The air gathered near the outside surface of the inner housing 16 is free to re-enter the inner housing 16 through the water dispersing slots 34.

Arranged within the lower part 20 of the dust-suppression sub-assembly is a sub-assembly for lubricating the rock drill bit 14 as indicated generally at 60. The lubricating sub-assembly 60 comprises a cylindrical tube section 62 fixed at its upper terminal end to the lower terminal end of the central supporting rod 26 of the spiral raceway 24 through an annular retention bush 63 which is preferably fitted into the tube section 62 and which is fixed onto the lower terminal end of rod 26. The lower terminal end of tube section 62 is fixed within above-mentioned annular support bush 40, so that the tube section 62 extends coaxially within the lower part of the inner housing 16 and is axially fixed with respect thereto.

The lubricating sub-assembly further comprises a pneumatically activated one-way valve assembly arranged to dispense predetermined quantities of a lubricant from the lubricating sub-assembly. In the illustrated embodiment of FIG. 1, the one-way valve includes a poppet-type hollow actuator rod or plunger tube 64 which is arranged coaxially within the tube section 62 and extends within the hollow supporting rod 26 and protrudes from the terminal upward end of the dust-suppression sub-assembly as can be seen at the top of FIG. 1. The plunger tube 64 is arranged to reciprocate within hollow rod 26 and tube section 62 against the biasing force of a spring 66 arranged between an upper collar 68 of the tube 26 and an actuator head section 70 connected to the upper terminal end of the plunger tube 64. A screw 72 is removably secured into the upper terminal end of the actuator head section body 70 and provides a means for filling up the hollow plunger tube 64 with lubricant. The terminal lower end of the hollow plunger tube 64 is closed and only a dispensing orifice 74 is arranged in the circumferential wall near the bottom end of the plunger tube 64 as will be described herein below. At least two oil balance holes, one of which is indicated at 65 are provided in the circumferential wall of the plunger tube 64 such that lubricant filled into the plunger tube can ingress into the chamber 76 formed between the inner surfaces 77 of the tube section 62, the outer surface 78 of the plunger tube 64, the downward facing surface 79 of the retention bush 64 and an annular sealing bush 80 fitted into the lower end to close tube section 62 and which has an axially extending bore with an inner diameter adapted to receive the lower terminal end of the plunger tube 64 with a fit preventing leakage of lubricant contained in chamber 76 past the annular seal surface 82 facing the lower terminal circumferential surface of plunger tube 64.

The plunger tube 64 may have an outer diameter to correspond with the inner diameter of the raceway supporting rod 26 or be smaller such as to form an annular chamber also within the supporting rod 26. In such case, the upper terminal end of the raceway support tube 26 has to be sealed with respect to the upper end of plunger tube 64. Thus, the interior of plunger tube 64, the optional annular chamber defined between the inner surface of the raceway support tube 26 and the exterior surface of the plunger tube 64 and the chamber defined within the tube section 62 provide a predetermined volume which is fillable with lubricant for lubricating the bearings of the drill bit attached to the sub-assembly.

It should be noted that the spring constant of spring 66 and the shape of the actuator body 70 are to be dimensioned such that they maintain the dispensing orifice 74 at the lower end of plunger tube 64 facing the seal surface 82 when in a deactivated position of the valve and such as to move the plunger tube 64 in downward direction thereby shifting the dispensing orifice 74 into the widened inner diameter bore 84 of sealing bush 80 upon positive air pressure of predetermined value being applied at the actuator head section 70 of the plunger tube 64. It should be appreciated that the profile of the inside surface of the central axial bore through the sealing bush 80 can be chosen and adapted to provide a desired lubricant flow rate out of dispensing orifice 74 into the widened inner diameter bore section 84. Of course, other types of seal seats can be implemented, for example, where the plunger tube 64 is a (non-hollow) plunger rod and the actual dispensing orifice would be provided on the seating bore surface of the seal bush 80 itself, and a predetermined upward movement of the plunger rod would be required to dispense lubricant through said orifice. Different types of valve seats and valve plungers may be used instead of the illustrated one and are readily available to the skilled person. A preferred form of a pressurising valve assembly is discussed below in connection with FIG. 5.

Figure 3:
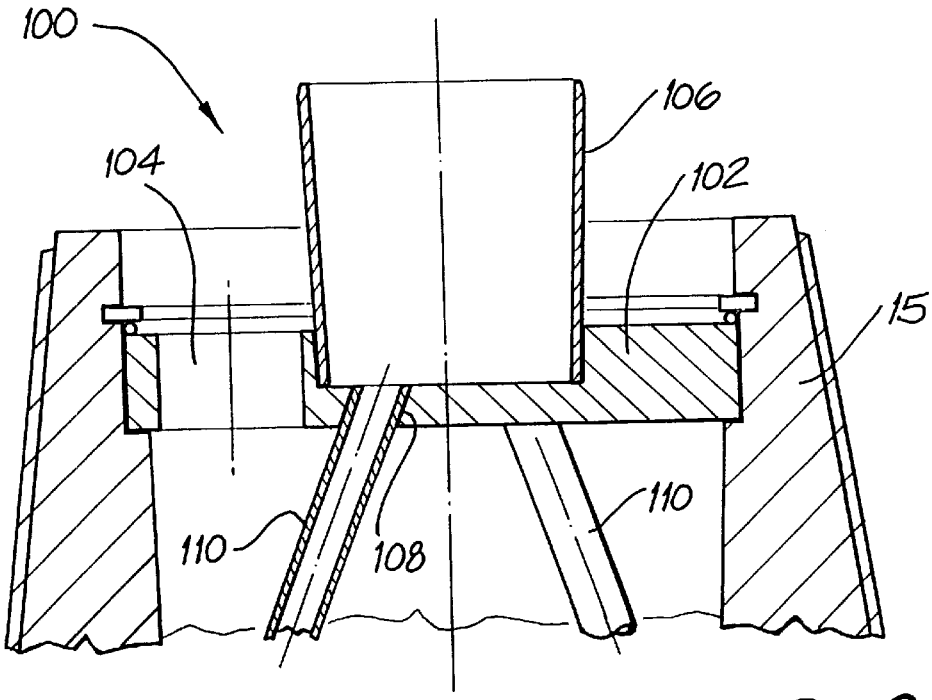
FIG. 3 is a schematic cross-section of an adaptor for mounting within the threaded shoulder connection of the drill bit illustrated in FIG. 2 such as to provide a means for communicating the interior of a lubricant cavity of the lubricating sub-assembly illustrated in FIG. 1 with at least some of the air circulation passages of the drill bit which extend to the bearings for the bit cones, the adaptor forming part of the sub-assembly.
Figure 4:
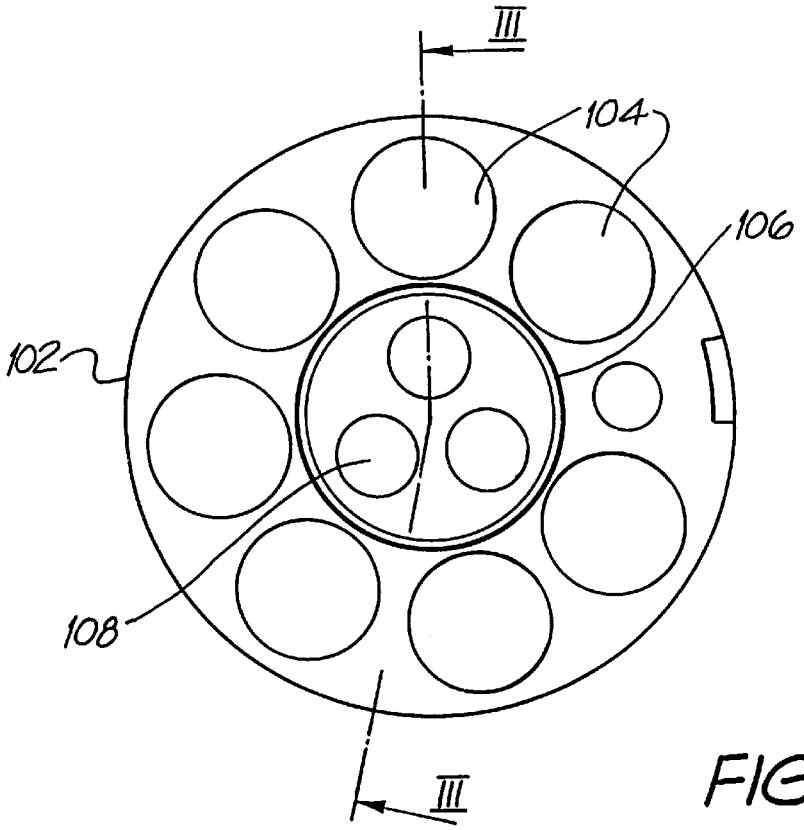
FIG. 4 is a top view on the adaptor of FIG. 3.

The lubricating sub-assembly further includes a communicating adaptor 100 illustrated in FIGS. 3 and 4. The adaptor is used to provide fluid communication between the central bore 84 of sealing bush 80 on one side and air circulation passages 92 to leading the bearings 90 for the bit cones 94 supported on the bit body 96 of the drill bit 14 illustrated in FIG. 2 on the other side. The adaptor 100 comprises a circular plate member 102 having, in the illustrated embodiment, seven equidistantly spaced apart axial through holes 104 spaced radially from and surrounding a connecting tube 106 welded into a cylindrical sack hole on the upper surface of support plate 102. Three inclined mounting bores 108 extend through the central region of support plate 102 between the upper and lower surfaces such as to communicate the interior of connecting tube 106 with the lower side of support plate 102. Within each mounting hole 108 is fixedly received a communication tube 110 extending in downward direction from the supporting plate 102 with a defined angle of inclination. The adaptor assembly 100 is received within the threaded rotary connection neck 15 of the drill bit body (see also FIG. 2). To this end, a stepped recess is machined on the inside of the rotary connection neck 15 as is schematically illustrated in FIG. 3. Once mounted, the adaptor assembly 100 is fixed against rotation and axial movement either by welding or appropriate retention means such as a key and circlip assembly. The adaptor 100 is arranged within the connection collar 15 of the drill bit 14 such that the three communication tubes 110 are connected to a respective tubular connection interface member 112 which itself communicates with the air circulation passages 92 provided in the body 96 of the drill bit 14 (see FIG. 2). The air circulation passages 92 are in communication with the different bearings 90 supporting the rotary drill cones 94 on the legs of the drill bit body 96. The layout of such drill bit 14 is conventional and will not be described in any further detail.

Thus, the adaptor assembly 100 provides a leak-free communication path from the interior of connecting tube 106 of the lubricating sub-assembly 60 to the bearings 90 housed in the drill bit body 96 via the communication tubes 110 and air circulation passages 92. The connecting tube 96 has such dimensions as to be received with a tight, leak-free fit within the bore 84 of the sealing bush 80 in the lower part 20 of the outer housing 10 when the threaded rotary shouldered connection 15 is threaded into the correspondingly threaded connector section 12 of the sub-assembly. Thus, fluid communication is provided between the lubricant filled cavities of the lubricating-sub-assembly 60 (the adaptor assembly 90 forming part thereof) and the air circulating passages 92 leading to the bearings 90 of the drill bit 14. Fluid communication can be regulated or completely shut-off by the plunger tube 64 of the one-way valve assembly which thus acts as a backflow valve for supplying predetermined lubricant amounts to the bearings of the drill bit.

Figure 5:
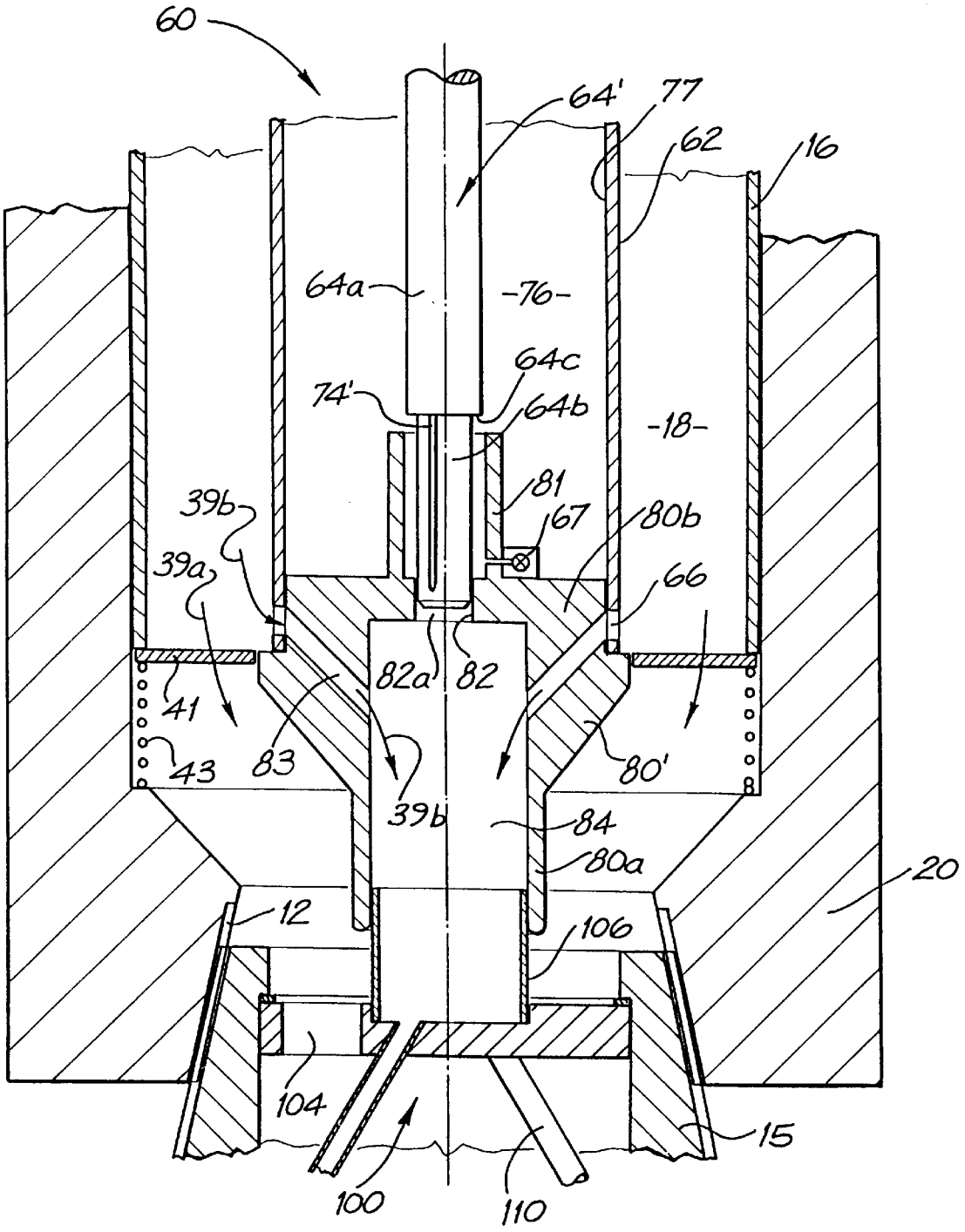
FIG. 5 is a schematic longitudinal section of a second embodiment of the lubricating sub-assembly.

Turning now to FIG. 5, there is illustrated a second embodiment of the lubricating sub-assembly, generally indicated at 60. Apart from the differences noted below, the sub-assembly is similar to the one described with reference to FIG. 1, and the same reference numerals will be used to denote same as functionally similar parts and element.

As described above with reference to FIG. 1, the lubricating sub-assembly 60 is mounted within the lower part 20 of the dust suppression sub-assembly and comprises a cylindrical tube section 62 fixed at its upper terminal end to a component of the dust sub-assembly. The interior of the tube section 62 provides the lubricant filled chamber 76. The annular support bush of the embodiment of FIG. 1 which supports the lower end of tube section 62 within the inner cylindrical housing 16 of the dust suppression sub-assembly is replaced by non-illustrated radially extending web members, which center tube section 62 to extend coaxially within the inner housing 16, and by a displaceable annular plate 41 which closes the lower terminal annulus between tube section 62 and the cylindrical inner housing 16. Annular plate 41 is supported in a position in which it abuts on the lower terminal end of inner housing 16 by a coil-spring 43 with a small spring coefficient which itself is supported on a ledge formed in the internal cavity of the lower part 20 of the outer housing 10. The inner edge of the annular plate 41 is guided along a short length of seat member 80'— (which will be described later in more detail) which closes the lower end of tube section 62. The coil spring 43 and annular plate 41 thus form an airlock which is opened when positive air pressure is applied to the dust suppression assembly as described above, thereby allowing air passage as indicated by arrow 39*a* once depressed and prevents backflow of any fluids into the dust suppression sub-assembly when the drill bit is being driven too hard into the bore head surface as occasionally happens.

As previously described with reference to FIG. 1, a pneumatically activated one-way valve assembly is arranged to dispense a metered quantity of the lubricant which is received within holding chamber of tube section 62. In the embodiment illustrated in FIG. 5, the one-way valve includes a poppet-type hollow or solid actuating rod 64' which is arranged coaxially within the tube section 62 for reciprocating movement and which is operated in the manner previously described above with reference to FIG. 1. The illustrated lower part of the actuating rod 64' is subdivided into a first, upper section 64*a* of greater diameter than a second, lower end section 64*b*, so that an annular shoulder 64*c* is formed between the two sections 64*a*, 64*b* and which provides a displacement piston surface.

The seal bush or seat member 80' is fixedly fitted into the lower end to close tube section 62 and comprises an upper cylindrical boss portion 80*b* which mounts tube section 62, and a lower cylindrical connection collar 80*a*. A bore 82*a* which provides the cylindrical sealing surface 82 extends axially through the boss portion 80*b* and has an inner diameter adapted to receive the lower terminal rod end 64*b* with a fit allowing movement of the rod within the bore 82*a* but preventing leakage of lubricant from chamber 76 to a substantial extent past the annular seal surface 82 on which the circumferential surface of the lower rod end 64*b* abuts.

Bore 82*a* ends in a dispensing bore 84 of greater diameter which is formed in collar 80*a* of the sealing bush 80'. As will be further noted from FIG. 5, an axially extending dispensing channel or slit 74' is machined into the outer peripheral surface of lower end rod section 64*b* to extend from the shoulder 64*c* close to the terminal end of the rod 64'.

In upward extension of the boss portion 80*b* of sealing bush 80' and integral therewith is formed a pressurization cylinder 81 which has an inner diameter which corresponds to the outer diameter of upper rod section 64*a*. The latter can be immersed into the pressurization cylinder 81 so that the piston surface 64*c* pressurization the lubricant amount which is received therein so as to dispense the metered lubricant under pressure upon the actuating rod 64' being moved in downward direction and the dispensing channel 74' reaching a position in which it is in fluid communication with the dispensing bore 84. This is achieved when positive air pressure of predetermined value is applied at the upper, non-illustrated actuator rod head section as previously described. A backflow valve 67 is arranged to provide fluid communication between the interior of the pressurization cylinder 81 and the lubricant chamber 76 to allow lubricant ingress when plunger rod 64' is moved in upward direction after the lubricant dispensing operation is finalized. Thus, the metered amount of lubricant contained in the pressurization cylinder 81 is dispensed to lubricate the bearings for the drill bit cones supported on the drill bit body as previously described with reference to FIG. 2.

As can be further seen in FIG. 5, the cylindrical collar 80*a* of sealing bush 80' receives therein in fluid tight fit the connecting tube 106 of the communicating adaptor 100 which is mounted in the threaded rotary shoulder connection 15 of the drill bit, so that lubricant entering the dispensing bore 84 is injected into the communicating tubes 110 which lead to the air circulation passages provided in the body of the drill bit (see previous description).

In further modification of the embodiment illustrated in FIG. 1, cooling air is branched off the air supply chamber 18 of the dust suppression assembly into dispensing bore 84 to be supplied as indicated by arrow 39*b* together with the metered lubricant to the bearings of the drill bit. To this end, a total of 4-inclined air passage bores 83 extend from the outer peripheral surface of the boss portion 80*b* of the bush 80' to the dispensing bore 84 of sealing bush 80'. The lower end of tube section 62 is heretofore provided with 4 bores which align with the corresponding openings of the air passage bores 83.

The lubricant amount which will be dispensed from the pressurization cylinder 81 and the pressurization degree will depend on the geometry of the cylinder 81, the displacement stroke length of piston surface 64*c*, diameters of rod sections 64*a*, 64*b* and dimensions and location of dispensing channel 74', of which more than one can be provided.

In operation of the combined dust suppression and lubricating sub-assembly as illustrated in FIG. 1 or FIG. 5, debris created by action of the drill bit are driven upwards from the drill bit along the bore hole by the air jettisoned through a jet nozzle 93 arranged in the cavity dome 95 between the individual bit cones 94 of the drill bit 14. Upon the debris-air mixture reaching the region of the radial holes 22 in the outer housing of the dust suppression sub-assembly area, it is wetted, the air then carrying the resultant slurry up the bore hole. The dust suppression sub-assembly ensures that little air remains in the debris extraction water compared to that initially fed through the mouth 28 of the inner housing 16 of the sub-assembly at the beginning of the spiral raceway. Accordingly, essentially dry air (90%–96% air) is delivered to the drill bit; the drill bit cones 94 are therefore subject to the blast of air only, rather than a thick slurry of water, air and debris which rapidly wears the drill bit and its bearings. Also, the essentially dry air reaches through appropriately spaced air circulation passages within the bit body the different bearings of the cone bits thus effectively cooling the bearings. These air circulation passages are preferably additional to those to which the communication tubes 110 are connected; otherwise, the tubular interface members 112 (shown in FIG. 2) have to be of a type which also admit air, apart from lubricant. The substantial absence of water from the air received within the drill bit body ensures minimal water induced corrosion of the bearings. Furthermore, the lubricant sub-assembly 60 provides a predetermined lubricant amount from the lubricant chamber of the sub-assembly upon actuation of the one-way valve assembly through the adaptor assembly via its communication tubes and the air circulation passages within the body of the drill bit to the bearings, thereby substantially reducing frictional wear and enhancing corrosion protection.

It is self-evident that the lubricating sub-assembly can be provided as a separate, self-contained modular section which can be connected between the drill bit and the dust suppression sub-assembly, or to the stabilizer, in absence of use of a sub-assembly for dust suppression. As illustrated, the lubricating sub-assembly can be built into the dust suppression sub-assembly or even the stabilizer.

The inventive concept has been described with reference to particular embodiments and it should be appreciated that it may be embodied in other ways. For instance, the dispensing valve assembly may be different and not necessarily be actuated only upon positive air pressure being applied through the drill string to the drill bit. The size of the tube section 62 may be adapted to hold a predetermined lubricant volume therefore avoiding the need of re-filling the lubricating sub-assembly prior to a time at which the drill bit cones have to be replaced due to normal wear of the working or cutting surfaces thereof. Furthermore, it will be appreciated that the tube section 62 could be omitted altogether in case the available volume within the hollow plunger tube is big enough to hold a sizeable quantity of lubricant. Alternatively, and as indicated above, the plunger tube may not be hollow as in the embodiment of FIG. 1, therefore requiring a modified actuation and dispensing mechanism wherein the plunger rod closes a dispensing orifice in the seat member or bush 80 as illustrated in FIG. 5; the plunger is then moved in a controlled manner in upward direction to allow passage of predetermined quantities of lubricant from the chamber within the tube section into the dispensing bore.

With a lubricating sub-assembly in accordance with the present invention mounted in a drill string, a considerable increase in consumable bit life is achieved by way of preventing water corrosion of the bearings of the drill bit and enhacing bearing lubrication. It is to be understood that the lubricating oil can also be directed to other friction surfaces and it is equally evident that a lubricating sub-assembly can be incorporated in a drill string using hammer drills instead of the illustrated roller bit drill.

Providing a direct lubrication of the bearings and friction surfaces on the drill bit by way of a lubricating sub-assembly in accordance with the present invention substantially increases life expectancy and reduces otherwise high wastage of lubricants in the presently carried out method of admixing soluble oil with the water used for dust suppression or injecting oil directly into the main air-line. Lubricant storage inside the specially devised sub-assembly, which can easily be retrofitted into existing drill strings, enables direct application of lubricant to the bearings and wear surfaces with no loss of lubricant. It is expected that bearing life will increase by at least a factor of four (4) as compared to conventional assemblies and methods of operation of drill bits. Advantageously, the lubricant holding chambers of the lubricating sub-assembly can be dimensioned such as to hold enough lubricant to enable the drill bit to be operated to last 10, 000 meters drilling length before replacement or repair of the drill bit cones due to frictional wear of cutting surfaces becomes necessary, since only small amounts of lubricant are necessary to reduce friction and enhance bearing life to such an extent that life expectancy of the bearings is higher than the cutting surfaces of the drill.

The invention claimed is:

1. A lubricating sub-assembly for a rock drill, the rock drill including a drill string carrying at its front end a drill bit having one or more air circulation passages designed to provide a flow of air to bearings within the drill bit, said lubricating sub-assembly comprising:

a housing being adapted to couple into the drill string;

a cavity disposed within the housing for holding a predetermined amount of a bearing lubricant;

means for communicating an interior of the cavity with said one or more air circulation passages; and means for dispensing a variable amount of the bearing lubricant from the cavity to the means for communicating.

2. A lubricating sub-assembly according to claim 1 and arranged to be linked as a module into the drill string adjacent the drill bit.

3. A lubricating sub-assembly according to claim 1 or 2, wherein the means for dispensing are arranged to dispense the lubricant only when air is being conveyed through the drill string into the drill bit during drilling operations.

4. A lubricating sub-assembly according to claim 1 or 2, further comprising means for dust suppression.

5. A lubricating sub-assembly according to claims 1 or 2, wherein the lubricating sub-assembly is a self-contained modular unit, the housing being attached between a dust suppression sub-assembly and the drill bit.

6. A lubricating sub-assembly according to claim 1, wherein the housing comprises an outer housing portion and an inner housing portion, the inner housing portion defining at least part of the cavity, and at least one air passage being defined between the inner and outer housing portions for air to pass through the sub-assembly and be directed to the drill bit.

7. A lubricating sub-assembly according to claim 6, wherein the inner and outer housing portions are co-axial cylinders of different radii.

8. A lubricating sub-assembly according to claim 1 or 2, wherein the means for dispensing comprise a pneumatically activated one-way valve arranged such as to be operable by air flow through the drill string, into a lubricant dispensing position.

9. A lubricating sub-assembly according to claim 8, wherein the one-way valve includes a poppet-type actuating rod biased to close a dispensing opening between the cavity and the means for communicating.

10. A lubricating sub-assembly according to claim 9, wherein the actuating rod is hollow with at least one longitudinal end thereof closed such as to define a part cavity for the lubricant, wherein said housing comprises an outer housing portion and an inner housing portion, the inner housing portion having an interior defining at least part of the cavity, an interior of the actuating rod being in fluid communication with the interior of the inner housing portion, the dispensing opening being provided near the closed longitudinal end of the rod so as to communicate the interior of the rod with its exterior and arranged to be closed against a sealing surface when the rod is in a non-dispensing position and be opened towards the means for communicating upon actuation of the rod by displacing the rod into a dispensing position.

11. A lubricating sub-assembly according to claim 10, wherein the actuating rod is received co-axially within the inner housing portion.

12. A lubricating sub-assembly according to claim 9, wherein the actuating rod is hollow with at least one longitudinal end thereof closed, the dispensing opening being provided near the one longitudinal end of the rod so as to communicate an interior of the rod with an exterior of the rod and arranged to be closed against a sealing surface when the rod is in a non-dispensing position and be opened towards the means for communicating upon actuation of the rod by displacing the rod into a dispensing position, and wherein said housing comprises an outer housing portion and an inner housing portion, wherein the actuating rod has an outer diameter substantially equal to an inner diameter of the inner housing portion such as to be received with a slide fit within the inner housing, the actuating rod substantially defining the cavity for holding the bearing lubricant.

13. A lubricating sub-assembly according to claim 10, wherein the closed longitudinal end of the rod is at least partially received within an annular seat with an intermediate fit that enables the actuating rod to reciprocate therein, the dispensing opening being arranged in the circumferential wall of the rod such that when the rod is in the non-dispensing position, the dispensing opening is closed by an internal surface of the annular seat, and when the rod is in the lowered dispensing position, lubricant can exit the dispensing opening to enter the means for communicating.

14. A lubricating sub-assembly according to claim 9, wherein the dispensing opening is dimensioned for gravity feed at a predetermined flow rate.

15. A lubricating sub-assembly according to claim 1, wherein pressurization means are provided in communication with the cavity and are arranged for generating a pressure differential to expel the bearing lubricant through an appropriately dimensioned dispensing opening and with a predetermined flow rate.

16. A lubricating sub-assembly according to claim 10, wherein at least one of the cavity and the actuating rod is arranged such as to be refillable.

17. A lubricating sub-assembly according to claim 16, wherein, the actuating rod is provided at a terminal upper end with an opening communicating with the interior of the rod and closable by a screw received within said opening.

18. A lubricating sub-assembly according to claim 16 or 17 wherein, the actuating rod comprises at least one lubricant balance hole.

19. A lubricating sub-assembly according to claim 9, wherein the poppet-type actuating rod includes a piston portion, and said housing includes a cylinder portion in fluid communication with said cavity, said piston portion slidably fit within said cylinder portion, and arranged to provide positive pressurization of the lubricant upon the rod being moved into a dispensing position.

20. A lubricating sub-assembly according to claim 9, comprising an annular seat member having an annular seat around said dispensing opening, the dispensing opening closed by an internal surface of said annular seat when said rod is in a non-dispensing position, wherein the rod comprises a first, upper portion of greater diameter than a second, lower end portion, an annular shoulder between the portions providing a displacement piston surface which can be reciprocatingly moved into and out of a pressurization cylinder formed as an extension of the annular seat member, a dispensing channel or slit being formed in the lower end portion and in fluid communication between the pressurization cylinder and the means for communicating when the rod is moved into a dispensing position.

21. A lubricating sub-assembly according to claim 20, wherein a backflow valve is provided between the interior of the pressurization cylinder and the cavity holding the lubricant to allow passage of lubricant from the cavity into the pressurization cylinder while the rod is moved back into a non-dispensing position.

22. A lubricating sub-assembly in combination with a drill string carrying at its front end a drill bit, said combination comprising:

a housing being coupled into the drill string;

a cavity disposed within the housing for holding a predetermined amount of a bearing lubricant;

one or more air circulation passages included in the drill bit, said air passages designed to provide a flow of air to bearings within the drill bit;

means for communicating an interior of the cavity with said air passages; and means for dispensing a variable amount of the bearing lubricant from the cavity to the means for communicating.

23. A lubricating sub-assembly for a rock drill, the rock drill including a drill string carrying at its front end a drill bit having one or more air circulation passages designed to provide a flow of air to bearings within the drill bit, said lubricating sub-assembly comprising:

a housing being adapted to couple into the drill string;

a cavity disposed within the housing for holding a supply of bearing lubricant;

passages in fluid communication with an interior of the cavity and with one or more air circulation passages of the drill bit;

a valve seat defining a dispensing opening, the valve seat located within said passage; and a valve member shaped to close said valve seat when in a non-dispensing position, and to at least partially open said valve seat when in a dispensing position.

24. A lubricating sub-assembly according to claim 23, wherein said valve member comprises a reciprocating rod arranged for reciprocation within said housing, said rod penetrating, at least in part, said cavity and arranged vertically reciprocatable to open and close said dispensing opening.

25. A lubricating sub-assembly according to claim 24 further comprising:

a hollow rod arranged within said housing to guide said reciprocating rod, and a spiral raceway surrounding and connected to said hollow rod, and an outer housing portion surrounding said spiral raceway and having intermittent slots through a circumferential wall thereof;

and comprising an inner housing portion within said outer housing portion, an interior thereof defining at least a portion of said cavity;

said inner housing portion having an outer diameter less than an inner diameter of said outer housing portion such as to define an annular passage therebetween, said annular passage open to said spiral raceway, said annular passage in air fluid communication with said drill bit;

said housing surrounding said outer housing portion, said housing having holes through a circumferential wall thereof in fluid communication with said slots; and said hollow rod substantially sealed to said inner housing portion.

26. A lubricating sub-assembly according to claim 25, wherein said reciprocating rod is substantially hollow and defines a portion of said cavity, said reciprocating rod having a substantially closed end and at least one radial passage which is closed by said valve seat when said reciprocating rod is in a non-dispensing position.

27. A lubricating sub-assembly according to claim 25, wherein said annular passage between said inner housing portion and said outer housing portion is substantially closed by an annular plate having holes therethrough for the passage of air.

28. A lubricating sub-assembly according to claim 24 further comprising a cylinder portion formed within said cavity and having a substantially open top end for receiving said reciprocating rod and having a bottom end in fluid communication with said dispensing opening, and having a back flow valve in fluid communication with said cavity and with said cylinder portion to replenish said cylinder portion with bearing lubricant, said reciprocating rod having a piston surface for pressurizing bearing lubricant within said cylinder portion during travel of said reciprocating rod to a dispensing position.

* * * * *